US006280482B1

(12) United States Patent
Ouziel et al.

(10) Patent No.: US 6,280,482 B1
(45) Date of Patent: Aug. 28, 2001

(54) METHOD OF TREATING NATURAL OR SYNTHETIC POLYAMIDE FIBER MATERIALS

(75) Inventors: Philippe Ouziel, Altkirch; Jean-Marie Adam, Rosenau, both of (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/609,955

(22) Filed: Jul. 5, 2000

Related U.S. Application Data

(63) Continuation of application No. 09/309,231, filed on May 10, 1999, now abandoned.

(30) Foreign Application Priority Data

May 13, 1998 (EP) ..... 98810433

(51) Int. Cl.[7] ..... D06P 1/52; D06P 3/24; D06P 5/08

(52) U.S. Cl. ..... 8/490; 8/557; 8/558; 8/675; 8/924; 8/930

(58) Field of Search ..... 8/557, 558, 115.62, 8/924, 495, 490, 930

(56) References Cited

U.S. PATENT DOCUMENTS

| | | | |
|---|---|---|---|
| 3,984,202 | 10/1976 | Saunders et al. | 8/165 |
| 4,097,546 | 6/1978 | Lofquist | 260/857 |
| 4,822,373 | 4/1989 | Olson et al. | 8/115.6 |
| 4,937,123 | 6/1990 | Chang et al. | 428/96 |
| 5,464,452 | 11/1995 | Cole et al. | 8/495 |
| 5,948,125 | 9/1999 | Ouziel | 8/552 |
| 6,039,768 | 3/2000 | Ouziel | 8/543 |

FOREIGN PATENT DOCUMENTS

| | | |
|---|---|---|
| 2213172 | 2/1998 | (CA) . |
| 1254743 | 11/1971 | (GB) . |
| 2024874 | 1/1980 | (GB) . |
| 89/07519 | 8/1989 | (WO) . |

*Primary Examiner*—Margaret Einsmann
(74) *Attorney, Agent, or Firm*—Kevin T. Mansfield

(57) ABSTRACT

A method of improving the stability to ozone exposure of dyes on natural or synthetic polyamide fiber materials comprises treating the fiber material, before, during or after dyeing, with a liquor comprising a homopolymer or copolymer having structural repeating units of formula (1)

(1)

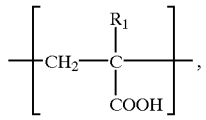

in which $R_1$ is unsubstituted or substituted $C_1$–$C_4$alkyl. The resulting dyeings and prints feature improved ozone fastness with no effect on hue, colour yield and other fastness properties such as light fastness, for instance.

15 Claims, No Drawings

METHOD OF TREATING NATURAL OR SYNTHETIC POLYAMIDE FIBER MATERIALS

This is a continuation of application Ser. No. 09/309,231, filed on May 10, 1999 now abandonded.

The present invention relates to a method of treating natural or synthetic polyamide fibre materials to improve the stability of the dyes to ozone exposure.

Dyeings, and prints made with dyes, often show themselves to be of high sensitivity to ozone. Anthraquinone dyes, for example, are easily broken down by ozone oxidation and so change their absorption characteristics and hence the colour. This phenomenon is observed in the case of blue anthraquinone dyes in particular. The hue of a trichromatic dyeing based on blue anthraquinone dyes on a nylon carpet, for example, is easily altered by exposure to ozone. This defect is generally countered by treating the dyed polyamide fibre material with resins based on phenol-formaldehyde condensates. However, the known ozone stabilizers have disadvantages, such as poor efficacy or an adverse effect on other fastness properties—the light fastness, for example. There is therefore a need for improved ozone stabilizers for the treatment of natural or synthetic polyamide fibre materials, dyed in particular with anionic dyes, without the abovementioned disadvantages.

It has now been found that the stability of dyeings made, for example, with anionic dyes on polyamide fibre material can be improved without adversely affecting other fastness properties if these dyeings are subjected to treatment with certain homopolymers or copolymers.

The present invention therefore provides a method of improving the stability to ozone exposure of dyes on natural or synthetic polyamide fibre materials, which comprises treating the fibre material, before, during or after dyeing, with a liquor comprising a homopolymer or copolymer having structural repeating units of formula (1)

(1)

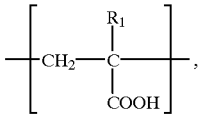

in which $R_1$ is substituted or unsubstituted $C_1$–$C_4$alkyl.

Examples of suitable $C_1$–$C_4$alkyl for $R_1$ are methyl, ethyl, n- or iso-propyl, n-, iso-, sec- or tert-butyl, these alkyl radicals being unsubstituted or substituted, for example, by halogen, such as fluorine, chlorine or bromine, hydroxyl or sulfo.

$R_1$ is preferably $C_1$–$C_4$alkyl and especially methyl.

The homopolymers or copolymers used in accordance with the invention as ozone stabilizers preferably contain from 50 to 100 mol % and, in particular, from 80 to 100 mol % of structural repeating units of formula (1). Where the polymers used in accordance with the invention are copolymers, examples of suitable copolymerizable monomers are compounds that contain anionic or nonionic groups.

Examples of monomers containing anionic groups are the following unsaturated compounds: acrylic acid, maleic acid, fumaric acid, itaconic acid, mesaconic acid, citraconic acid, vinylacetic acid vinyloxyacetic acid, vinylpropionic acid, crotonic acid, aconitic acid, allylacetic acid, allyloxyacetic acid, α,β-dimethylacrylic acid, allylmalonic acid, allyloxymalonic acid, methylenemalonic acid, glutaconic acid, β-carboxyethyl acrylate, allyloxy-3-hydroxybutanoic acid, allylsuccinic acid, acrylamidoglycolic acid, vinylsulfonic acid, (meth)allylsulfonic acid, (meth) acrylamidomethylpropanesulfonic acid, (meth) acrylamidopropanesulfonic acid, (meth) acrylamidoethanesulfonic acid, (methacrylamidomethanesulfonic acid, sulfopropyl (meth) acrylate and styrenesuffonic add.

Examples of monomers containing nonionic groups are the following unsaturated compounds:

maleic anhydride, vinylcaprolactam, diallylamine, N-methyidiallylamine, N-ethyidiallylamine, N-vinylpyrrolidone, N-vinylformamide, N-vinylacetamide, N-vinyl-N-methylformamide, N-vinyl-N-methylacetamide, N-vinyl-N-ethylacetamide, N-vinylimidazole, N-vinyl-N-methylimidazole, N-vinylimidazoline, N-vinyl-2-methyimdazoline, N-vinylcaprolactam, vinyl acetate, vinyl propionate, vinyl butyrate, $C_1$–$C_{22}$alkyl vinyl ketone, $C_1$–$C_{22}$alkyl vinyl ethers, olefins such as ethylene, propylene, isobutene, styrene or its derivatives, such as hydroxystyrene, 1,2-dimethoxyethylene, hydroxy-$C_1$–$C_4$alkyl (meth) acrylate, (meth)acrylic acid $C_1$–C22alkyl esters, (meth) acrolein, (meth)acrylonitrile, (meth)acrylamide, N-mono/N,N-di-$C_1$–$C_{10}$alkyl (meth)acrylamide, ($C_1$–$C_4$)alkoxy (meth)acrylates, N,N-di-Cl-$C_2$alkylamino-$C_1$–$C_4$alkyl (meth)acrylates, unsaturated acetals, ketals or orthocarboxylic esters such as 2,5-dimethoxy-2,5-dihydrofuran and 2-methoxy-3, 4dihydro-2H-pyran. Preferred copolymerizable monomers in the polymers used in accordance with the invention are:

acrylic acid, maleic acid, vinylacetic acid, acrylamidoglycolic acid, (meth)acrylamido-methanesulfonic add, vinylsulfonic acid, (methallylsulfonic acid, (meth) acrylamidomethyl-propanesulfonic acid, (meth) acrylamidopropanesulfonic acid, (meth) acrylamidoethane-sulfonic add, (meth) acrylamidomethanesulfonic add, sulfopropyl (meth) acrylate, 4-styrene-sulfonic acid, maleic anhydride, N-vinylpyrrolidone, vinylcaprolactam, N-vinylformamide, N-vinyl-N-methylformamide, N-vinylacetamide, N-vinyl-N-methylacetamide, N-vinylimidazole, vinyl acetate, vinyl propionate, vinyl butyrate, $C_1$–$C_{10}$alkyl vinyl ketone, $C_1$–$C_6$alkyl vinyl ethers, ethylene, propylene, isobutene, styrene, hydroxy-ethyl/propyl/butyl (meth)acrylate, (meth) acrylic acid $C_1$–$C_6$alkyl esters, (meth)acrolein, (meth) acrylonitrile, (meth)acrylamide, N-mono/N,N-di-$C_1$–$C_6$alkyl (meth)acrylamide, 2,5dimethoxy-2,5-dihydrofuran and 2-methoxy-3,4-dihydro-2H-pyran.

Especially preferred copolymerizable monomers in the polymers used in accordance with the invention are: vinylsulfonic acid, 2-acrylamido-2-methylpropanesulfonic acid, 3-(meth)acrylamidopropane-sulfonic acid, maleic anhydride, N-vinylpyrrolidone, N-vinylformamide, N-vinyl-N-methyl-formamide, N-vinylacetamide, N-viny-N-methylacetamide, N-vinylimidazole, vinyl acetate, styrene, hydroxy-ethyvpropyl (meth)acrylate, (meth)acrylic acid $C_1$–$C_6$alkyl esters, (meth)acrylonitrile, (meth) acrylamide, N-mono/N,N-di-$C_1$–$C_6$alkyl (meth)acrylamide and 2-methoxy-3,4-dihydro-2H-pyran.

Particularly important copolymerizable monomers in the polymers used in accordance with the invention are: vinylsulfonic acid, 3-(meth)acrylamidopropanesulfonic acid and 2-methoxy-3,4-dihydro-2H-pyran.

It is also possible to use mixtures of two or more of the abovementioned homopolymers or copolymers in the method of the invention.

The homopolymers or copolymers used in the method of the invention have an average molecular weight of from 1000 to 1 000 000, preferably from 1000 to 500 000 and, in particular, from 5000 to 200 000.

The preparation of the homopolymers or copolymers used in accordance with the invention as ozone stabilizers, comprising structural repeating units of the abovementioned formula (1), takes place in a conventional manner by, for example, ionically or, preferably, free-radically initiated polymerization of the monomers of the formula (2)

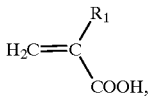

(2)

where $R_1$ has the general and preferred definitions indicated above in, for example, solution, suspension or emulsion, in the presence or absence of the unsaturated compounds exemplified above as copolymerizable monomers. This polymerization preferably takes place in solution with a peroxide, persulfate or azo compound, for example with sodium persulfate or azobis(2-amidinopropane) hydrochloride, as free-radical chain initiator, the latter being present, for example, in an amount of from 0.005 to 10% by weight based on the monomers employed.

Irrespective of the liquor ratio, the homopolymers or copolymers used in the method of the invention are employed, for example, in an amount of from 0.05 to 10% by weight, preferably from 0.1 to 6% by weight and, with particular preference, from 0.5 to 4% by weight, based on the weight of the polyamide fibre material.

Treatment of the polyamide fibre material of the homopolymers or copolymers used in accordance with the invention can be carried out before, during or after dyeing, preferably during or after dyeing.

Where the treatment of the polyamide fibre material with the homopolymers or copolymers used in accordance with the invention takes place during the dyeing operation the method of the invention is advantageously performed by adding the polymers to the dyeing liquor in the amount indicated above and carrying out conventional dyeing of the fibre material.

Where the treatment of the polyamide fibre material with the homopolymers or copolymers used in accordance with the invention takes place after dyeing the method of the invention is advantageously performed by first carrying out conventional dyeing of the polyamide fibre material and then adding an aftertreatment with a fresh aqueous liquor comprising the polymers in the amount indicated above. Subsequently, the dyed polyamide fibre material can be dewatered without a further rinsing operation and dried conventionally. The aftertreatment generally takes place in a fresh liquor. However, it can also be carried out directly in the dyebath provided that the dyebath is substantially exhausted at the end and is still sufficiently acidic. The treatment is generally followed by brief rinsing with cold water.

Suitable polyamide fibre material includes natural polyamide fibre material, such as wool or silk, or synthetic polyamide fibre material, such as nylon 6 or nylon 6.6, or else fibre blends such as woovcellulose or nylon/cellulose blends or nylontwool blends. The fibre material is preferably synthetic polyamide fibre material.

The textile material can be employed in any form, for example as fibre, yam, wovens or knits.

The dyeings take place, for example, with anionic dyes, suitable anionic dyes being all those which are customary, as are described, for example, in the Colour Index, 3rd edition (1971) and its supplements under the headings "Acid Dyes".

Examples are sulfo-containing monoazo, polyazo, metal complex azo, anthraquinone, phthalocyanine and formazan dyes.

The dyeings are preferably made with anthraquinone dyes and in particular with blue anthraquinone dyes.

The anionic dyes used to dye to polyamide fibre material are in the form either of their free sulfonic acid or, preferably, of its salts.

Examples of suitable salts are the alkali metal, alkaline earth metal and ammonium salts or the salts with an organic amine. Examples include the sodium, lithium, potassium and ammonium salts or the salt with mono-, di- or triethanolamine.

The anionic dyes used to dye the polyamide fibre material may include further additives, such as sodium chloride or dextrin.

Dyeing of the polyamide fibre material with anionic dyes can be carried out in accordance with the dyeing or printing techniques customary for these dyes, such as by the exhaust process. Apart from water and the dyes, the dyeing liquors or printing pastes may include further additives, examples being wetting agents, antifoams, levelling agents or agents which affect the nature of the textile material, such as softeners, flame retardants or soil, water and oil repellents, and also water softeners and natural or synthetic thickeners, such as alginates and cellulose ethers.

The amounts in which anionic dyes are used in the dyebaths or printing pastes may vary widely depending on the desired depth of colour; in general, amounts of from 0.01 to 15% by weight, in particular from 0.01 to 10% by weight, based on the material to be dyed or on the printing paste, have been found to be advantageous.

Dyeing wfth anionic dyes preferably takes place at a pH of from 3 to 7, in particular of from 4 to 7; in the presence of the homopolymers or copolymers used in accordance with the invention, dyeing is preferably conducted at a pH of from 2 to 7 and, in particular, from 4 to 7. The liquor ratio can be chosen from within a wide range, for example from 5:1 to 50:1, preferably from 5:1 to 30:1. Dyeing is preferably carried out at a temperature from 70 to 110° C., in particular from 80 to 105° C.; in the presence of the homopolymers or copolymers used in accordance with the invention dyeing is preferably conducted at from 50 to 1 00° C. and, in particular, at from 80 to 100° C. Aftertreatment with the homopolymers or copolymers used in accordance with the invention preferably takes place in accordance with the exhaust process. In this case the liquor ratio can be chosen from within a wide range and is for example from 4:1 to 100:1, preferably from 10:1 to 40:1 and, in particular, from 5:1 to 40:1.

Special equipment is unnecessary. The conventional dyeing apparatus, examples being open baths, winchbecks, jiggers, or paddle, jet or circulation apparatus, can be used, for example.

It is judicious to operate at a temperature of, for example, from 20 to 100° C., preferably from 50 to 1 00° C. and in particular from 60 to 100° C. The treatment time may, for example, be from 10 to 60 minutes and preferably from 15 to 40 minutes. The pH of the liquor is generally from 2 to 7, preferably from 4 to 7 and, in particular, from 4 to 6.

In addItion to the fixing agent the liquor may include other customary additives, examples being electrolytes such as sodium chloride or sodium sulfate, dispersants and wetting agents, and defoamers.

The method of the invention produces dyeings or prints made with dyes, for example anionic dyes, on polyamide fibre material which evidence a considerable improvement in ozone fastness without any adverse effect on the colour yield, hue or light fastness properties.

The examples which follow serve to illustrate the invention. The temperatures indicated are in degrees Celsius, and parts and percentages are by weight unless noted otherwise. The relationship between parts by weight and parts by volume is that of the kilogram to the litre.

PREDARATION EXAMPLES

Example 1

A reactor is charged with 68.8 parts of methacrylic acid, 4.4 parts of mercaptoethanol and 146 parts of water. Under nitrogen, the temperature is brought to 75° C. A solution of 1 part of sodium persulfate and 10 parts of water is added dropwise over the course of 30 minutes. The reaction is exothermic and the temperature rises to 85° C. Polymerization is continued at 85° C. for one hour. Then, at 80° C., 13.8 parts of 30% hydrogen peroxide are added and the mixture is stirred at this temperature for 2 hours. The polymer solution is cooled, adjusted to a pH of 6.5 and concentrated to a solids content of 40%. This gives approximately 210 g of a clear, pale yellow viscous solution of a polymer having mainly structural units of the formula (101)

(101)

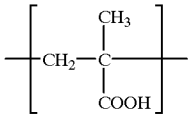

and a molecular weight of approximately 8000.

Example 2

A reactor is charged with 65 parts of isopropanol and 17.5 parts of water and this initial charge is heated to 80° C. under nitrogen. Then a solution of 64.5 parts of methacrylic acid, 10.3 parts of 2-acrylamido 2-methylpropanesulfonic acid and 22.5 parts of water is added dropwise over the course of 120 minutes. At the same time a solution of 8.3 parts of sodium persulfate and 25 parts of water is added dropwise over the course of 150 minutes. Polymerization is continued at about 80° C. for 3 hours. The polymer solution is diluted with water, the isopropanol is removed by distillation, and the remaining solution is concentrated to a solids content of 20%. This gives approximately 400 g of a cloudy, viscous solution of a polymer having mainly structural units of the formula (101) and (102)

(102)

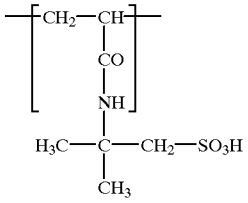

and a Brookfieid viscosity of 1600 cP.

Example 3

A reactor is charged with 69.5 parts of isopropanol and 19 parts of water and this initial charge is heated to 80° C. under nitrogen. Then a solution of 64.5 parts of methacrylic acid, 21.7 parts of a 30% aqueous solution of sodium vinylsulfonate, 69.3 parts of isopropanol and 140.7 parts of water is added dropwise over the course of 120 minutes. At the same time a solution of 7.5 parts of sodium persulfate and 25 parts of water is added dropwise over the course of 150 minutes. Polymerization is continued at about 80C for 3 hours. The polymer solution is diluted with water, the isopropanol is removed by distillation, and the remaining solution is concentrated to a solids content of 30%. This gives approximately 260 g of a cloudy, viscous solution of a polymer having mainly structural units of the formula (101) and (103)

(103)

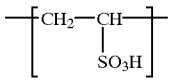

and a Brookfield viscosity of 970 cP.

Example 4

A reactor is charged with 5.25 parts of 2-methoxy-3,4-dihydro-2H-pyran and 12 parts of o-xylene and this initial charge is heated to 90° C. under nitrogen. Then a solution of 35 parts of methacrylic acid and 20 parts of o-xylene is added dropwise in the course of 100 minutes. At the same time 0.8 parts of tert-butyl 2-ethylperhexanoate and 20 parts of o-xylene are added dropwise over the course of 120 minutes. Polymerization is continued at about 90° C. for 2 hours. The polymer solution is diluted with water and the o-xylene is removed by azeotropic distillation. The polymer solution is adjusted to a pH of 7 and concentrated to a solids content of 20%. This gives approximately 180 g of a clear, slightly viscous solution of a polymer having mainly structural units of the formula (101) and (104)

(104)

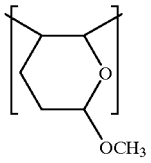

with a Brookfield viscosity of 30 cP.

USE EXAMPLES

Example 5

A dyebath containing 600 parts of water, 0.0108 part of a dye of the formula

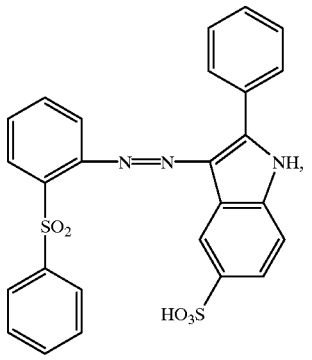

0.0135 part of a dye of the formula

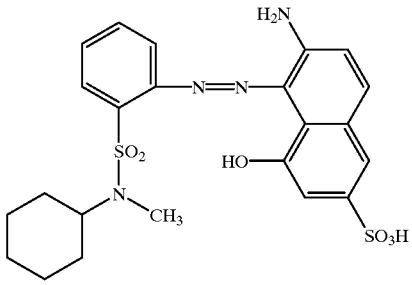

and 0.033 part of a dye of the formula.

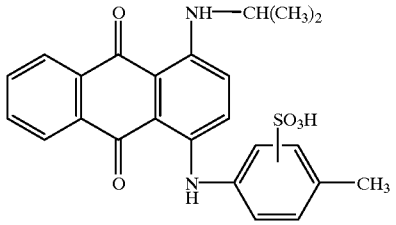

is adjusted to a pH of 6.5 using 0.72 part of sodium dihydrogen phosphate monohydrate and 0.6 part of disodium hydrogen phosphate dodecahydrate. This dyebath is entered at 30° C. with 30 parts of nylon 6 carpet fabric. The temperature is increased at a uniform rate over 45 minutes to the boiling point, after which dyeing is carried out at this temperature for 30 minutes. The grey-dyed carpet is subsequently rinsed. The dyed carpet fabric is aftertreated in a fresh bath comprising 600 parts of water, 1.5 parts of the polymer solution of Example 1 (2% by weight of polymer based on the carpet fabric), 0.6 part of sodium acetate and 0.7 part of acetic acid at a pH of 4.5 and a temperature of 75° C. for 15 minutes. The carpet fabric is subsequently rinsed and dried. The ozone fastness of the resulting dyeing is tested in accordance with ISO 105-G03. Comparison of the aftertreated carpet fabric with a carpet fabric which has not been aftertreated shows a marked increase in the ozone stability of the aftertreated carpet fabric.

Following the procedure described in Example 5 but using, instead of 2% by weight, based on the carpet fabric, of the polymer of Example 1, the equivalent amount of one of the polymers of one of Examples 2 to 4, the result is likewise a polyamide carpet fabric with a grey, ozone-fast coloration.

Example 6

A dyebath containing 600 parts of water, 0.0108 part of a dye of the formula

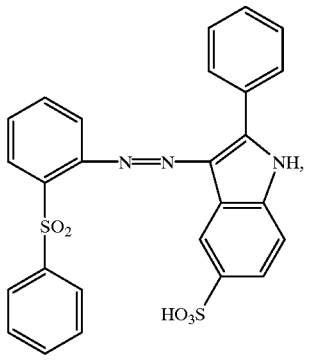

0.0135 part of a dye of the formula

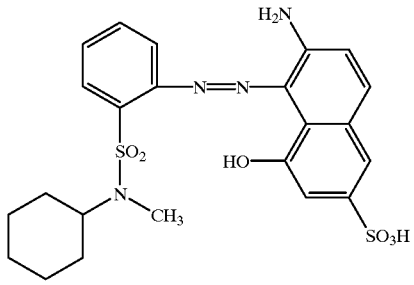

and 0.033 part of a dye of the formula.

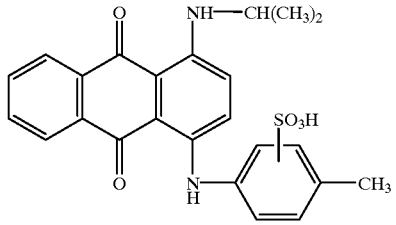

and 1.5 parts of the polymer solution from Example 1 (2% by weight) is adjusted to a pH of 6.5 using 0.72 part of sodium dihydrogen phosphate monohydrate and 0.6 part of disodium hydrogen phosphate dodecahydrate. This dyebath is entered at 30° C. with 30 parts of nylon 6 carpet fabric. The temperature is increased at a uniform rate over 45 minutes to the boiling point, after which dyeing is carried out at this temperature for 30 minutes. The grey-dyed carpet is then briefly rinsed cold and dried. The ozone fastness of the resultant dyeing is tested in accordance with ISO 105-G03. Comparison of the dyed carpet fabric with a carpet fabric not dyed in the presence of the polymer solution from Example 1 shows a marked increase in the ozone stability.

Following the procedure described in Example 6 but using, instead of 2% by weight, based on the carpet fabric, of the polymer of Example 1, the equivalent amount of one of the polymers according to one of Examples 2 to 4, the result is likewise a polyamide carpet fabric with a grey, ozone-fast coloration.

What is claimed is:

1. A method of improving the stability to ozone exposure of anthraquinone dyes on natural or synthetic polyamide fibre materials, which comprises treating the fibre material, before, during or after dyeing with anthracuinone dyes, with a liquor comprising a homopolymer or copolymer having structural repeating units of formula (1)

(1)

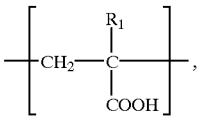

in which $R_1$ is unsubstituted or substituted $C_1$–$C_4$alkyl, whereby the ozone stability is improved.

2. A method according to claim 1, wherein $R_1$ is $C_1$–$C_4$alkyl.

3. A method according to claim 1, wherein the homopolymer or copolymer contains from 50 to 100 mol % of structural repeating units of the formula (1).

4. A method according to claim 1, wherein the homopolymer or copolymer has an average molecular weight of from 1,000 to 1,000,000.

5. A method according to claim 1, wherein the homopolymer or copolymer is present in the liquor in an amount of from 0.05 to 10% by weight based on the weight of the polyamide fibre material.

6. A method according to claim 1, wherein the fibre material is treated during or after dyeing.

7. A method according to claim 6, wherein treatment with the liquor comprising the homopolymer or copolymer is conducted at a pH of from 2 to 7.

8. A method according to claim 6, wherein treatment with the liquor comprising the homopolymer or copolymer is conducted at a temperature of from 50 to 100° C.

9. A method according to claim 1, wherein treatment with the liquor comprising the homopolymer or copolymer takes place by the exhaust process.

10. A method according to claim 1, wherein the fibre material is synthetic polyamide fibre material.

11. A method according to claim 7, wherein treatment with the liquor comprising the homopolymer or copolymer is conducted at a pH of from 4 to 7.

12. A method according to claim 2, wherein $R_1$ is methyl.

13. A method according to claim 3, wherein the homopolymer or copolymer contains from 80 to 100 mol % of structural repeating units of the formula (1).

14. A method according to claim 4, wherein the homopolymer or copolymer has an average molecular weight of from 5,000 to 200,000.

15. A method according to claim 5, wherein the homopolymer or copolymer is present in the liquor in an amount of from 0.1 to 6% by weight based on the weight of the polyamide fibre material.

* * * * *